United States Patent [19]

Strubel

[11] Patent Number: 4,892,109

[45] Date of Patent: Jan. 9, 1990

[54] SIMULATED SMOKING ARTICLE

[75] Inventor: David G. Strubel, Louisville, Ky.

[73] Assignee: Brown & Williamson Tobacco Corporation, Louisville, Ky.

[21] Appl. No.: 320,428

[22] Filed: Mar. 8, 1989

[51] Int. Cl.[4] ..... A24F 1/00; A24B 15/00

[52] U.S. Cl. ..... 131/194; 131/273; 131/359

[58] Field of Search ..... 131/273, 194, 195, 360, 131/359

[56] References Cited

U.S. PATENT DOCUMENTS

| | | | |
|---|---|---|---|
| 3,258,869 | 6/1966 | Ellis et al. | 131/273 |
| 4,149,548 | 4/1979 | Bradshaw | 131/273 |
| 4,474,191 | 10/1984 | Steiner | 131/198.2 |
| 4,732,168 | 3/1988 | Resce et al. | 131/359 |
| 4,735,217 | 4/1988 | Gerth et al. | 131/273 |
| 4,756,318 | 7/1988 | Clearman et al. | 131/273 |
| 4,793,365 | 12/1988 | Sensabaugh et al. | 131/335 |
| 4,813,437 | 3/1989 | Ray | 131/273 |
| 4,819,665 | 4/1989 | Roberts et al. | 131/194 |

*Primary Examiner*—V. Millin
*Assistant Examiner*—Jennifer L. Doyle
*Attorney, Agent, or Firm*—Charles G. Lamb

[57] ABSTRACT

A smoking article including a cylindrical, open ended sleeve with a capsule concentrically located within the sleeve and cooperating with the sleeve to define an annular air flow passage therebetween. The capsule includes chemical reactants which exothermally react when mixed together. A porous substrate including an aerosol generating substance is located in the sleeve downstream of the capsule and annular air flow passage so that air flowing from the annular passage flows through the porous substrate. A filter is located at one end of the sleeve adjacent to and downstream of the porous substrate.

7 Claims, 1 Drawing Sheet

SIMULATED SMOKING ARTICLE

BACKGROUND OF THE INVENTION

The present invention relates to a simulated smoking article and devices, and, more particularly, to non-combustible simulated smoking devices which include a flavor releasing material and/or aerosol generating material which is volatilized by air which has been heated by a contained exothermic chemical reaction.

Various proposals have been made to provide a simulated smoking article which provides a tobacco taste without the combustion of tobacco.

These prior art proposals are exemplified by U.S. Pat. No. 726,037 issued on Apr. 21, 1903 to H. Ferre; U.S. Pat. No. 2,860,638 issued on Nov. 18, 1958 to F. Bartholomeo; U.S. Pat. No. 3,404,692 issued on Oct. 8, 1968 to A. Lampert; U.S. Pat. 4,149,548 issued on Apr. 17, 1979 to John C. Bradshaw; U.S. Pat. No. 4,284,089 issued on Aug. 18, 1981 to Jon P. Ray; U.S. Pat. No. 4,393,884 issued on July 19, 1983 to Allen W. Jacobs; and U.S. Pat. No. 4,474,191 issued on Oct. 2, 1984 to Pierre G. Steiner.

U.S. Pat. No. 726,037 teaches a inhaler having two elongated receptacles in side-by-side relationship inside a cylindrical sleeve. The receptacles are filled with cotton or other porous material. The porous material in one receptacle is an aqueous solution of, for example, hydrochloric acid and the porous material in the other receptacle is an aqueous solution of, for example, ammonium carbonate. When a person sucks on one end of the sleeve, air is drawn in separate streams through the cotton in each receptacle producing vapors which combine in a chamber in the sleeve downstream of the carbon filled receptacles to form a white vapor simulating smoke.

U.S. Pat. No. 2,860,638 teaches a smoking device (simulated) having a cylindrical member with a mouthpiece at one end. A tubular capsule is positioned inside the cylindrical member. The capsule is filled with cotton which is saturated with concentrated taste components, for example, nicotine. To use the device, holes are pierced in the upstream and downstream ends of the capsule. Thus, when a person sucks on the mouthpiece, air is drawn through the capsule and picks up the tobacco flavorant and carries it to the user's mouth.

U.S. Pat. No. 3,404,692 teaches a simulated cigarette inhaler device having a cylindrical sleeve which is closed at one end and has a mouthpiece at the other end. The cylindrical sleeve is filled with an absorbent material, such as cotton, which is saturated with tobacco extract. To use the device, a hole is made in the stored end of the sleeve and when a person sucks on the mouthpiece, tobacco extract is drawn into the mouth.

U.S. Pat. No. 4,149,548 teaches a simulated cigarette device having a central cylindrical sleeve fabricated of pliable plastic with cylindrical end portions of a plastic coated with an edible material. The central cylindrical sleeve is divided by a rupturable septum into two compartments. One compartment is filled with a water solution of hydrochloric acid and the other compartment is filled with a water solution of sodium hydroxide. The end cylindrical portions are filled with either water or a metal. When the central cylindrical sleeve is distorted as by bending or compression, the septum ruptures allowing the hydrochloric acid and sodium hydroxide solutions to mix resulting in a exothermic reaction which heats the water or metal in the cylindrical coating and portions which heats the edible material.

U.S. Pat. No. 4,284,089 teaches a simulated cigarette device which includes a cylindrical container filled with absorbent material saturated with a nicotine mixture. The absorbent material has a center channel therethrough. When air is sucked through the absorbent material it picks up nicotine and delivers it to the user's mouth.

U.S. Pat. No. 4,393,884 teaches a simulated cigarette device which includes a cylindrical tube with a pressurized cylinder of flavorant material located therein. A spring located valve device opens and closes an outlet at the end of the pressurized cylinder to selectively allow the flavorant material to flow out of the pressurized cylinder and into the user's mouth.

U.S. Pat. No. 4,474,191 teaches a smoking device shaped like a cigarette having a cylindrical envelope of non-combustible ceramic. Tobacco is enclosed in a chamber concentrically located in the envelope. Channels extend along the tobacco chamber between the tobacco chamber and cylindrical envelope. Tobacco simulating substances are deposited within the channels.

SUMMARY OF THE INVENTION

The present invention provides a novel simulated cigarette which delivers heated air carrying tobacco flavor to the smoker's mouth without the combustion of any fuel.

More particularly, the present invention provides a simulated smoking article comprising a cylindrical sleeve fabricated of a non-combustible material, a capsule concentrically located within the sleeve and cooperating with the sleeve to define an annular air flow passage therebetween, the capsule is divided into two chambers by a heat destructible partition or seal, a first chemical reactant is located in one chamber and a second chemical reactant is located in the other chamber, and a porous substrate including flavorant substances is located in the sleeve downstream of the capsule and air passage. The two chemical reactants combine to react exothermically.

BRIEF DESCRIPTION OF THE DRAWINGS

A better understanding of the invention will be had upon reference to the following description in conjunction with the accompanying drawings wherein like numerals refer to like parts throughout the views and in which.

DETAILED DESCRIPTION OF THE PREFERRED EMBODIMENT

Figure 1:
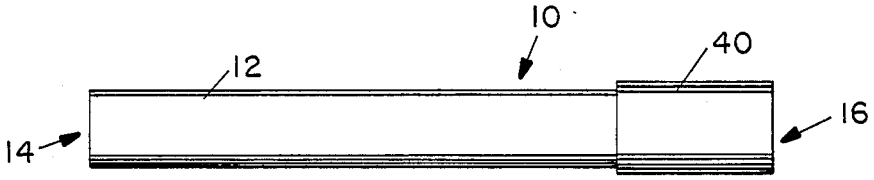
FIG. 1 is a longitudinal side view of the simulated smoking article of the present invention.

With reference to the Figures, there is shown a simulated smoking article, generally denoted as the numeral 10, of the present invention. As can be best seen in FIG. 1, the simulated smoking article 10 is configured to resemble a conventional filtered cigarette in appearance.

The simulated smoking article 10 includes a cylindrical sleeve 12 having open opposite ends 14 and 16 which is fabricated of a non-combustible material. Various suitable non-combustible materials are, such as, for example, a paper treated with a burn retardant material. And, the cylindrical sleeve 12 is of a size similar to the tobacco column of a cigarette.

A capsule 18 is concentrically located within the sleeve 12 extending from proximately one open end 14 of the sleeve 12 longitudinally thereof a distance less than the length of the sleeve 12.

Figure 2:
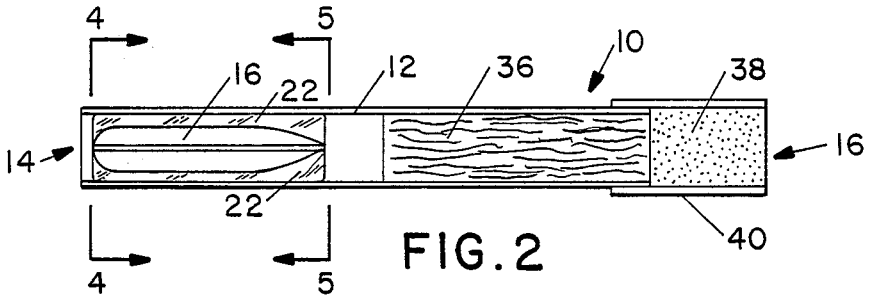
FIG. 2 is a longitudinal cross-sectional view of the simulated smoking article of the present invention.
Figure 3:
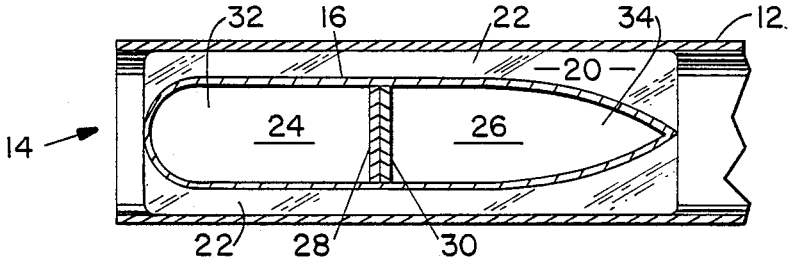
FIG. 3 is an enlarged, longitudinal cross-sectional view of a component of the simulated smoking article of FIG. 2.

As can be best seen in FIGS. 2 and 3, the outer circumference of the capsule 18 is smaller than the inside circumference of the sleeve 12 so that the capsule 18 and the sleeve 12 cooperate to define an annular air flow passage 20 therebetween concentric with the sleeve 12. The capsule 18 is fabricated of a heat conducting material such as, for example, aluminum, copper, and the like, having a high coefficient of heat transfer. The circumferential wall of the capsule 18 tapers in the longitudinal direction of the sleeve 12 away from the open sleeve end 14 such that the capsule tapers in the direction of flow of air through the annular passage 20. Thus, the annular air flow passage progressively increases in cross-sectional area in the longitudinal direction of the sleeve 12 toward the open sleeve end 16 at the opposite end of the sleeve 12 from the location of the capsule 18.

Figure 4:
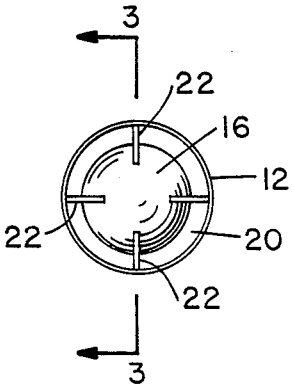
FIG. 4 is an enlarged end view as seen in the direction of arrows 4—4 in FIG. 2; and, FIG. 5 is an enlarged end view as seen in the direction of arrows 5—5 in FIG. 2.
Figure 5:
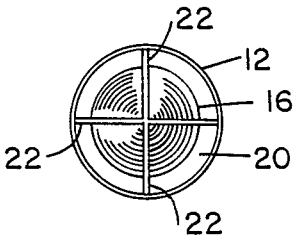

As can be best seen in FIGS. 3, 4, and 5, the capsule 18 further includes formations 22 on the outer or exterior surface of the wall of the capsule 12 exposed to the annular air flow passage 20 providing an increased heat transfer area of the capsule wall. As shown, the formations 22 are a plurality of fins attached to the wall of the capsule 18, projecting radically from the capsule 18, and spaced apart from each other circumferentially of the capsule 18. Also, at least some of the formations 22 can be sized to abut the inside circumferential surface of the sleeve 12 to locate and hold the capsule 18 in concentric relationship inside the sleeve 12.

With reference to FIG. 3, the interior of the capsule 18 is divided into a first chamber 24 and a second chamber 26 by a transverse heat destructible partition seal 28. By "heat destructible" it is meant to be the temperature or temperature range at which a material melts or ceases to function as a seal. The heat destructible partition seal 28 is preferably destructible within a narrow temperature range so that it will virtually immediately destruct when its heat destructible temperature is obtained. The seal 28 can be fabricated of numerous materials, such as, for example, a meltable wax. The melting temperature of the seal 28 should be above the ambient temperature normally experienced, for example, in a closed automobile or building. Preferably, therefore, the melting temperature of the seal 28 should be above 160° F. since this is a known temperature which can be reached inside the closed passenger compartment of a motor vehicle on a summer day.

With continued reference to FIG. 3, a fluid permeable membrane 30 is transversely located inside the capsule 18 adjacent to and coextensive with the seal partition 28.

A first chemical reactant 32 is located in the first chamber 24 and a second chemical reactant 34 is located in the second chamber 26. The first and second chemical reactants are selected from the groups which will react only exothermically, will not evolve a gas, and which are non-toxic individually and which create a non-toxic reaction product. An example of the first chemical reactant 32 would be water, and an example of the second chemical reactant 34 would be calcium oxide.

With reference once again to the transverse partition seal 28, the seal 28 should also be fabricated of an inert material which is non-reactive with the first chemical reactant 32, the second chemical reactant 34, or the reaction product.

With reference to the fluid permeable membrane 30, the permeability thereof is selected to provide the gradual passage therethrough of the first and second chemical reactants 32, 34 so that the first and second chemical reactants 32, 34 will gradually co-mix at a controlled rate for a predetermined period of time so that the exothermic reaction will continuously occur over the predetermined period of time. The fluid permeable membrane 30 can be fabricated of, for example, sintered ceramic materials or sintered metal which is non-reactive with the chemical reactants and non-reactive with the reaction product.

The simulated smoking article 10 further includes a porous substrate 36 located in the sleeve 12 downstream of the capsule 18 and the annular air flow passage 20 relative to the flow air through the annular air flow passage 20. The porous substrate 36 can be fabricated of various materials. For example, the porous substrate can be fabricated of charcoal, or tobacco, or a combination of charcoal and tobacco.

An aerosol generating material is included in the porous substrate. The aerosol generating material is selected so that it volatilizes or distills at the temperature of the air passing from the annular air flow passage 20 which has been heated by the exothermic reaction of the first chemical reactant 32 and second chemical reactant 34. One such aerosol generating material is, for example, glycerin.

With reference to FIGS. 1 and 2, the simulated smoking article 10 further includes a cylindrical filter plug 38 coaxially located at the open sleeve end 16. The filter plug 38 can be of the conventional construction for a filter used with cigarettes, such as, for example, cellulose acetate or polypropylene. The filter plug 38 can be attached to the cylindrical sleeve 12 by a cigarette tipping material 40 which circumscribes the filter plug 38 and circumferentially overlaps the cylindrical sleeve 12 proximate the open sleeve end 16.

In use, the user inserts the filter end of the sleeve 12 into his mouth and holds a flame at the open sleeve end 14 to heat the capsule 18 to a sufficient temperature to destroy the heat destructible partition seal 28, for example, by causing it to melt. The first and second chemical reactants then gradually flow together through the fluid permeable membrane 30 whereupon they co-mix resulting in an exothermic reaction which continues to occur over a predetermined period of time. The time can be the proximate time typically required to smoke a conventional cigarette, for example, five minutes. The user then sucks on the filtered end of the sleeve 12 drawing ambient air through the annular air flow passage 20. As the air moves through the annular air flow passage 20 it is heated by the exothermic reaction taking place inside the capsule 18. Due to the increasing cross-sectional area of the annular passage 20, the velocity of the air will slow as it moves through the passage 20 providing an increased length of time over which the exothermic reaction will heat the air. As the heated air passes through the porous substrate, it picks up flavorants and aerosol material and carries it through the filter plug 38 to the mouth of the user. The filter plug 38 is used primarily to provide a pressure drop approximating the pressure drop of a filtered cigarette.

The foregoing detailed description is given primarily for clearness of understanding and no unnecessarily limitations are to be understood therefrom for modifications will become obvious to those skilled in the art upon reading this disclosure and may be made without departing from the spirit of the invention and scope of the appended claims.

What is claimed is:

1. A simulated smoking article comprising:

a cylindrical sleeve open at its opposite ends and fabricated of a non-combustible material;

a capsule concentrically located within the sleeve extending from proximately one open end of the sleeve longitudinally of the sleeve a distance less than the length of the sleeve, the capsule having an outer circumference less than the inside circumference of the sleeve, and the capsule being fabricated of a heat conducting material;

a heat destructible seal located in the capsule dividing the interior of the capsule into a first chamber and a second chamber;

a fluid permeable membrane located in the capsule adjacent to and coextensive with the seal;

a first chemical reactant in the first chamber;

a second chemical reactant in the second chamber;

the first and second chemical reactants are selected from the group which reacts only exothermically, will not evolve a gas, and which are non-toxic individually and creates a non-toxic reaction product;

an annular air flow passage defined between the inside circumference of the sleeve and the outside circumference of the capsule;

a porous substrate located in the sleeve downstream of the capsule and air flow passage relative to the flow of air through the annular passage;

an aerosol generating substance in the substrate; and, a filter located adjacent the porous substrate at the other open end of the sleeve opposite the capsule.

2. The simulated smoking article of claim 1, wherein the circumferential wall of the capsule tapers in the longitudinal direction of the sleeve toward the end of the sleeve having the filter such that the annular air flow passage progressively increases in cross-sectional area the longitudinal direction of the sleeve toward the end of the sleeve having the filter.

3. The simulated smoking article of claim 1, wherein the capsule further comprises formations on its exterior surface exposed to the annular air flow passage providing an increased surface area of the capsule wall.

4. The simulated smoking article of claim 1, wherein the heat destructible seal has a destructive temperature with a narrow temperature range.

5. The simulated smoking article of claim 1, wherein the heat destructible seal is fabricated of an inert material which is non-reactive with the first and second chemical reactants.

6. The simulated smoking article of claim 4, wherein the heat destructible seal melts at temperatures above 160° F.

7. The simulated smoking article of claim 5, wherein said first chemical reactant is water and said second chemical reactant is calcium oxide.

* * * * *